United States Patent [19]

Ernst

[11] 4,125,175

[45] Nov. 14, 1978

[54] STAIRCASE WITH SMALL BASE AREA

[76] Inventor: Herbert Ernst, Burgstr. 7, 7765 Bodman, Bodensee, Germany

[21] Appl. No.: 760,505

[22] Filed: Jan. 19, 1977

[30] Foreign Application Priority Data

Jan. 20, 1976 [CH] Switzerland ..... 626/76

[51] Int. Cl.[2] ..... E04F 11/00

[52] U.S. Cl. ..... 182/194; 182/82; 182/228; 52/182

[58] Field of Search ..... 182/194, 228, 178, 82; 52/182, 187

[56] References Cited

U.S. PATENT DOCUMENTS

| | | | |
|---|---|---|---|
| 858,199 | 6/1907 | Modjeski | 182/194 |
| 3,474,882 | 10/1969 | Ernst | 182/178 |

FOREIGN PATENT DOCUMENTS

| | | | |
|---|---|---|---|
| 2,129,753 | 12/1972 | Fed. Rep. of Germany | 182/194 |

*Primary Examiner*—Reinaldo P. Machado
*Attorney, Agent, or Firm*—Karl F. Ross

[57] ABSTRACT

A staircase having a small base area is formed with one or more stringers and a plurality of horizontal treads placed along the stringer, the leading edges of alternate treads being set back from the usual tread edge and the setbacks alternating from side to side along the treads. The arrangement permits the treads in their unset back regions to overhang one another while the setback regions permits the foot to clear each tread in passing through the tread thereabove or therebelow. The arrangement permits a steep staircase to be negotiated with ease.

10 Claims, 9 Drawing Figures

STAIRCASE WITH SMALL BASE AREA

FIELD OF THE INVENTION

The invention relates to a staircase and, more particularly, to an improved staircase for use in situations in which only limited base area is available and/or the staircase must be relatively steep, thereby rendering use of a staircase with normal tread depth and rise impracical.

BACKGROUND OF THE INVENTION

It is known to provide a staircase which comprises at least one rigid stringer and a plurality of horizontal treads spaced apart along the stringer with a predetermined tread rise, i.e. vertical distance between the upper surface of one tread and the upper surface of the tread thereabove, and predetermined tread depth, i.e. horizontal distance between the projecting edge of the tread and the rear thereof. The stringer can be a single piece or can be formed by interconnected and detachable or permanently fixed pieces and, moreover, can be fabricated by connecting horizontal supports and vertical supports so that they can be disassembled or are permanently secured to one another.

A staircase of this type is described in German Auslegeschrift (published application (U.S. Pat. No. 1,659,756 (U.S. Pat. No. 3,474,882) and uses rigid "Z" shaped supports which are joined by inserting one vertical leg of a first Z support into a vertical leg of another Z support and either allowing the connection to pivot or locking the connection together. A sleeve and pin system or a telescoping sleeve arrangement can used to connect the Z shaped supports.

While this type of staircase has the advantages that it can be used for different staircase configurations, e.g. as a straight staircase, a staircase with one or more landings or bends, or a spiral staircase, it has the disadvantage that, for a given distance between two floors to be bridged by the staircase, the latter must extend over a fairly large base area. The term "base area" is used to describe the area occupied by the staircase as seen in plan view upon the supporting surface, i.e. the lower floor to which the staircase extends downwardly.

In normal circumstances, such as staircase may have twelve to fourteen treads or steps and, because the tread must have a given width (tread depth ignoring any overhang), the total base area or floor area required for the staircase can be obtained by multiplying the tread width by the number of treads forming the staircase. Where sufficient area is available, no problems arise. Frequently, however, there is insufficient area available fot the staircase and, accordingly, the staircase must be steeper than is comfortable or convenient. If the same number of treads must be used because of the given rise between treads, the treads overhanging one another quite substantially make it practically impossible to negotiate the staircase without striking the top of ones tow upon an overhanging tread in ascent and without obtaining purchase of the heel portion of the foot upon descent. Of course, if the tread width is narrowed substantially a sufficient portion cannot be obtained in either ascent or descent.

As a consequence, the use of the staircase frequently involves danger to the user.

OBJECTS OF THE INVENTION

It is the principal object of the present invention to provide a staircase which obviates these drawbacks and which can be negotiated safely by the user while occupying a substantially reduced base area than earlier staircases.

SUMMARY OF THE INVENTION

This object and other which will become apparent hereinafter, are attained, in accordance with the present invention in a staircase which comprises at least one stringer and a multiplicity of treads spaced apart along the stringer and having substantially corresponding tread lengths (horizontal dimension measured perpendicularly to the tread depth), the tread depth at one part of each tread being less than that at another part thereof so that the latter part of each tread is set back relative to the first part, the setback portion of the treads alternating from side to side up the staircase.

More specifically, the invention solves the problem of erecting staircases in extremely small areas by reducing the horizontal distance of the vertical supports to less than the required depth of a standard tread and by allowing the horizontal supports which carry the tread to protrude over the front of the vertical supports, the horizontal supports alternating from side to side on the stringer and reducing the distance between the vertical supports. By effectively reducing the depth of the tread from side to side alternately up or down the staircase there is provided a normal tread depth on each step at the region thereof intended to form the resting surface for the foot of the user while the remainder of the tread of the same step is set back to allow the other foot of the user to clear the step in moving to the next step. The use of the staircase is thus as safe and easy as any conventional staircase.

An important advantage of the present invention is that the setback of part of each alternate tread enables a substantial reduction in the floor area to be obtained to the extent that an area of $1m^2$ is sufficient for the erection of a staircase running twelve to fourteen steps between storeys.

The reduction of floor area gives rise to a further advantage in that the supporting forces have their principal components in the vertical direction. As a result of this smaller base area, therefore, complex anchorages of the staircase may become unnecessary, the bending forces on the stringer are reduced and the stringer can be made of members having smaller cross-section area (i.e. from smaller structural members), thereby reducing the weight of these members and the staircase structure and permitting a reduction in the cost of the staircase because of the material saving.

It may also be mentioned that the staircase of the present invention has some significant advantages as compared, for example, with retractable staircases, since it is easier to use and safer during descent, can be maintained in place when it is permanently erected, and obviates the need for a storage area as is necessary for a retractable when its use is not required.

According to a feature of the invention, the horizontal distance between two vertical supports plus the distance the horizontal support protrudes over the vertical support is equal to the depth of the respective tread. The horizontal distance between the vertical supports and the distance by which the tread protrudes over the vertical support is equal to half the depth of the tread.

Furthermore, when the staircase construction uses two parallel stringers and where each stringer has several horizontal treads protruding over the vertical support and where the two parallel stringers have the protruding horizontal supports offset to one another by a vertical distance corresponding to the rise between treads, the most suitable shape of the tread is to have half of the latter set back to the other, i.e. the depth one half the length of the tread equal to the length of the protruding horizontal support the setback portion. The depth of the other half of the length of the tread can correspond to a full tread width, this length being equal to the distance between vertical supports.

The treads can thus be L-shaped members (as seen in plan view) having rectangular portions cut away at alternating corners from side to side of a rectangular configuration, the latter configuration being defined by a length corresponding to the entire tread length and a width corresponding to the maximum tread breadth.

The treads can th s be L-shaped members (as seen in plan view) having rectangular portions cut away at alternating corners from side to side of a rectangular configuration, the latter configuration being defined by a length corresponding to the entire tread length and a width corresponding to the maximum tread breadth.

As described previously, the stringer can be one piece or can be fabricated from individual components which permit radial movement between the vertical supports so that any type of spiral configuration is possible. If it is found to be necessary, because of the lack of available floor area, to reduce the vase area of the staircase further, this can be achieved by turning two neighboring horizontal supports so that in plan view the angle between them is less than 180°. This angle between two neighboring supports can be disposed on the same side of one of the vertical supports or it can be alternated from one side to the other for every second tread. When the treads are cut from rectangular boards or the like, a right-angle cutout is preferred.

The treads can be made identical with alternating treads being inverted relative to one another.

BRIEF DESCRIPTION OF THE DRAWING

The above and other objects, features and advantages of the present invention will become more radily apparent from the following description, reference being made to the accompanying drawing in which.

SPECIFIC DESCRIPTION

Figure 1:
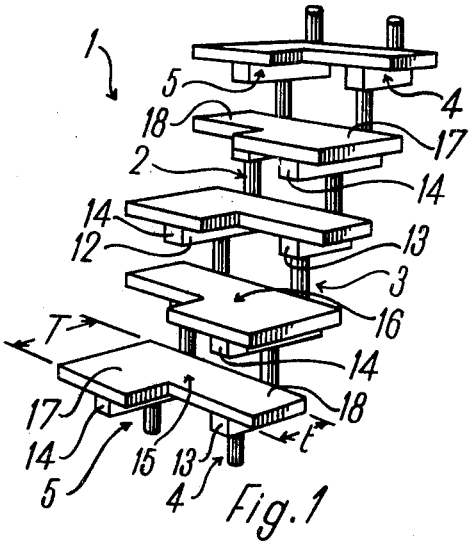
FIG. 1 is a perspective view of a portion of a staircase embodying the present invention.

As can be seen from FIG. 1, the staircase 1 comprises a pair of stringers generally represented at 2 and 3, formed by connected components 4 and 5.

Figure 4:
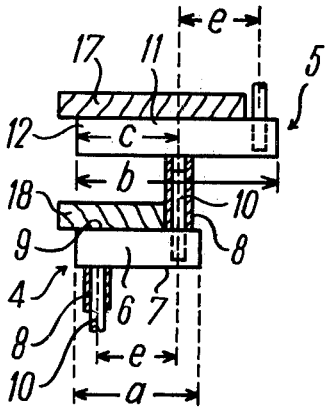
FIG. 4 is a partial section of the staircase as seen generally in the direction of arrows 3 and 3.

As is apparent from FIG. 4, the horizontal connecting component 4 can be a square tube which extends over substantially the entire breadth of the tread which is carried thereby. Attached to the bottom 7 of each support 6 formed by a tube 4, is a vertical sleeve 8 which received a pin 10 attached to the top 9 of the support.

The horizontal center-to-center distance between the pins 10 of adjacent treads and hence between the sleeves 8 is represented at *e*.

It will be apparent from the drawing that the support can also be formed by a single square tube 11 (FIGS. 6 through 8) extending over a distance *b* and to which a support sleeve 8 and a support pin 10 are attached at the top and bottom, respectively with a corresponding center-to-center spacing *e*. The cantilevered length is *c*.

The inside diameter of the support sleeve 8 and the outside diameter of the support pin 10 received therein are such that the sleeve 8 can be pushed over the pin 10 in a manner which does not permit of any vertical or horizontal movement after the connection is formed.

Figure 3:
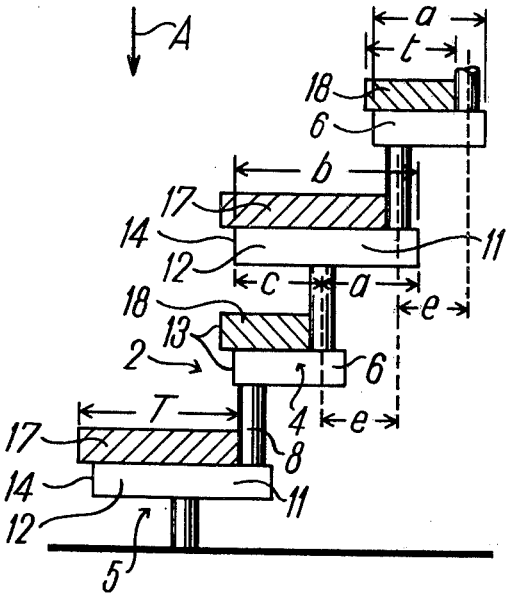
FIG. 3 is a cross section taken along the line 3—3 of FIG. 2.
Figure 2:
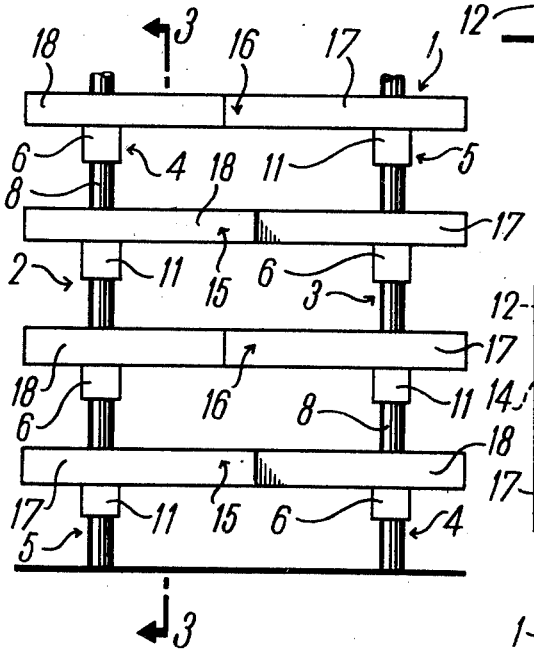
FIG. 2 is a front elevational view of this staircase.

The portion of the support 11 which projects through a distance *c* over the center line of the support pin 10 forms the supporting member 12. As shown in FIGS. 3 and 4 the distances *a*, *b* and *c* are such that the fronts 13 and 14 of the supports 6 and 11 (FIG. 3) are disposed above one another to terminate in the same vertical plane.

The treads 15 and 16 rest upon the supports 6 and 11 and can be made of wood, concrete or other tread-forming materials. The treads each have a wide portion 17 of a breadth T at one end and a narrow one 18 of breadth *t* at the other end, the breadths T and *t* being selected such that T is equal to the desired tread depth while *t* is not greater than the distance *e* between the vertical supports.

The treads 15 and 16 have right-angle cutouts in corners to the right and to the left so that these cutouts alternate with a similar alternation for the long and short supports 11 and 6 respectively. Each narrow portion of a tread is carried by the shorter support 6, while each wide portion of the tread is carried by the longer horizontal support 11.

Because of the alternation of the cutouts or setbacks, the wider tread portion 17 alternates from left to right up the staircase and a user can thus place the left foot on the wide tread portion 17 of the first step 15, the right foot on the wide tread portion 17 of the next stp 16 and then continue in this fashion up the stairs. The narrow portions 18 of the treads 15 and 16 do not support the feet of the user, but facilitate support of the steps, cover the openings which otherwise would be left between the treads, and permit the rising thereof of the user in proceeding between wide tread portions to clear the intervening step.

Figure 7:
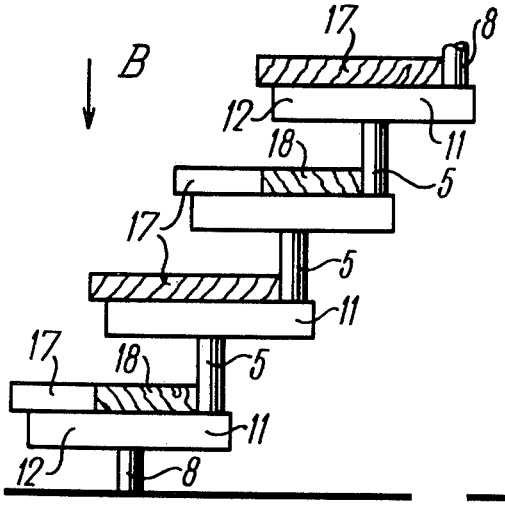
FIG. 7 is a section taken along the line 7—7 of FIG. 6.
Figure 6:
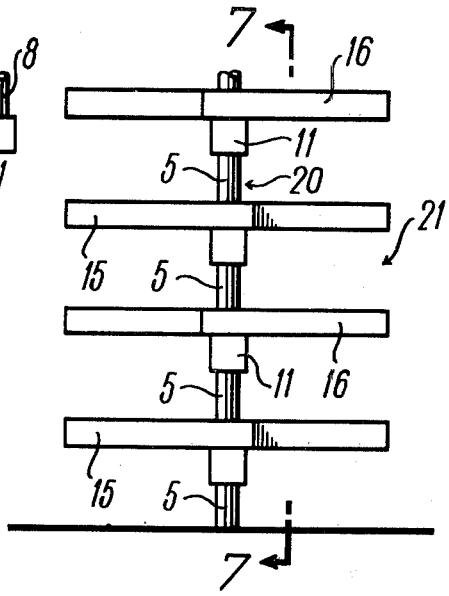
FIG. 6 is a front elevational view of another embodiment of the staircase according to the invention.
Figure 8:
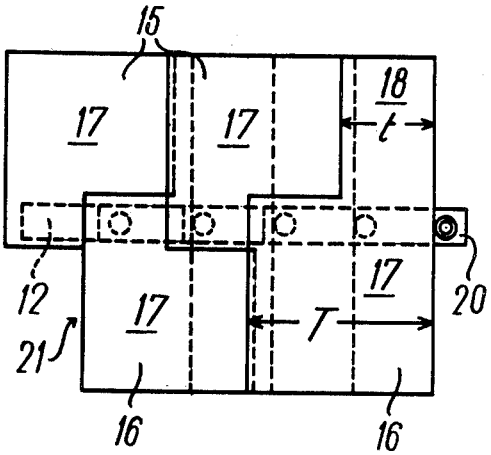
FIG. 8 is a plan view of this staircase as seen in the direction of arrow B of FIG. 7.

FIGS. 6 to 8 show a stringer 20 in the center of the staircase 21. In fabricating the stringer 20, only the components 5 are connected although the treads 15 and 16, which can be of the same configuration but are alternatingly inverted relative to one another and rest on top of the horizontal supports of the components 5. All of the advantages for functioning characteristics of the staircase 1 also apply to the staircase 21.

Figure 5:
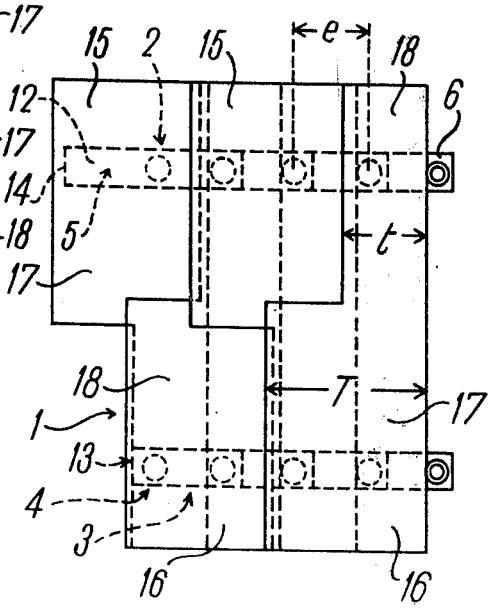
FIG. 5 is a plan view of the staircase in the direction of arrow A.
Figure 9:
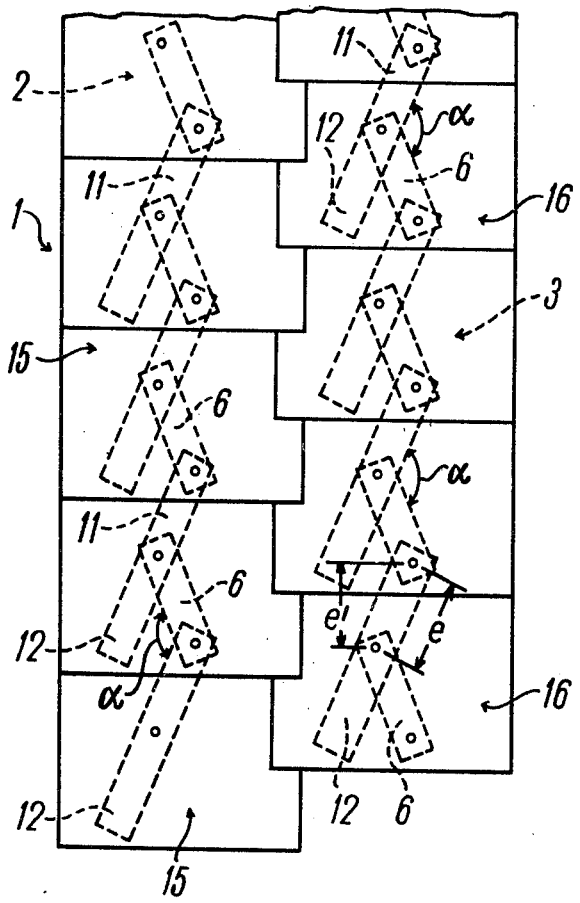
FIG. 9 is a plan view of a modified support structure for a staircase according to the invention.

FIG. 9 shows an arrangement similar to that of FIG. 5, the difference being, of course, the positions of the components 4 and 5 which are here anchored so that the horizontal supports 6 and 11 include angles $\alpha$ between them, the angle $\alpha$ being smaller than 180°. Because of the radial shift of the horizontal support 6, it is possible to obtain a reduction in a distance between the vertical members or pins to say, $e'$ which may be less than the distance $e$. This configuration has the important advantage that it allows the base area of the staircase to be further reduced.

The supports 2 and 3 or 20 of the staircase 1 and 21 can be fabricated by interconnecting the relatively pivotal components 4 and 5 in the preferred embodiment of the invention. Naturally, a similar staircase can be made by welding or bolting the components 4 and 5 together, in which case sleeve 8 can be omitted. A welded construction permits use of various materials permitting fusion, such as aluminum, permitting bolts, such as wood, or the use of other materials with corresponding properties. The support members can be of square, round or other profile and the fabrication can be effected at the erection site or in a workshop without great skill. Naturally the staircase need not be straight, as illustrated, but can be provided with bends or even erected with a spiral configuration.

I claim:

1. A staircase comprising at least one stringer and a succession of horizontal treads mounted on said stringer in vertically spaced relation, each of said treads having a wide tread portion along part of its length and a setback portion along another part of its length, the wide tread portions of the successive treads of the staircase alternating from side to side along the latter, said stringer comprising at least one horizontal support member carrying each of said treads and respective vertical members, interconnecting a successive support member at opposite ends thereof, the vertical members connected to each support member having a center-to-center spacing no greater than the width of said wide tread portions, two parallel stringers being disposed to the opposite sides of a vertical median plane through the staircase, the support members of each tread in the narrow tread portion thereof being shorter than the support member of each tread in the wide tread portion thereof.

2. The staircase defined in claim 1 wherein the center-to-center spacing of the vertical members attached to each support member is equal substantially to half the width of said wide tread portion.

3. The staircase defined in claim 1 wherein said stringer lies in a vertical median plane of the staircase.

4. The staircase defined in claim 1 wherein the wide tread portion of each tread extends substantially over half the length thereof, the narrow tread portion of each tread extending over the balance of the tread length.

5. The staircase defined in claim 1 wherein each of said treads is of generally rectangular configuration with a cutout at a corner thereof.

6. The staircase defined in claim 1 wherein said treads are all of identical geometry, alternate treads being inverted relative to one another.

7. A staircase comprising at least one stringer and a succession of horizontal treads mounted on said stringer in vertically spaced relation, each of said treads having a wide tread portion along part of its length and a setback portion along another part of its length, the wide tread portions of the successive treads of the staircase alternating from side to side along the latter, said stringer comprising at least one horizontal support member carrying each of said treads and respective vertical members, interconnecting a successive support member at opposite ends thereof, the vertical members connected to each support member having a center-to-center spacing no greater than the width of said wide tread portions, and means connecting each of said vertical members with a respective support member with freedom of relative angular adjustment, two adjacent support members including an angle in plan view which is less than 180°.

8. The staircase defined in claim 7 wherein the last-mentioned means includes a sleeve fixed to each of said support members and receiving a pin formed on an adjacent support member and constituting the vertical member thereof.

9. The staircase defined in claim 7 wherein each of said treads is of generally rectangular configuration with a cutout at a corner thereof.

10. The staircase defined in claim 7 wherein said treads are all of identical geometry, alternate treads being inverted relative to one another.

* * * * *